US008474629B1

(12) United States Patent
Allore et al.

(10) Patent No.: US 8,474,629 B1
(45) Date of Patent: Jul. 2, 2013

(54) SELF-CLEANING TRAMP METAL SEPARATION DEVICE FOR PNEUMATIC CONVEYING LINES

(75) Inventors: Dan Allore, Harbor Springs, MI (US); Brendan Ingalls, Boyne City, MI (US)

(73) Assignee: Industrial Magnetics, Inc., Boyne City, MI (US)

( * ) Notice: Subject to any disclaimer, the term of this patent is extended or adjusted under 35 U.S.C. 154(b) by 484 days.

(21) Appl. No.: 12/785,959

(22) Filed: May 24, 2010

(51) Int. Cl.
*B03C 1/00* (2006.01)

(52) U.S. Cl.
USPC ..... 209/223.1; 209/228; 209/229

(58) Field of Classification Search
USPC ..... 209/223.1, 223.2, 228, 229, 231
See application file for complete search history.

(56) References Cited

U.S. PATENT DOCUMENTS 4,620,923 A 11/1986 Meister
4,867,869 A * 9/1989 Barrett ..... 209/223.2
5,188,239 A 2/1993 Stowe
5,557,186 A * 9/1996 McMurtrey et al. ..... 318/626
5,740,919 A 4/1998 Stowe
6,077,333 A * 6/2000 Wolfs ..... 96/1
6,902,066 B2 * 6/2005 Yang ..... 209/223.1

* cited by examiner

*Primary Examiner* — Joseph C Rodriguez
*Assistant Examiner* — Kalyanavenkateshware Kumar
(74) *Attorney, Agent, or Firm* — Young Basile Hanlon & MacFarlane P.C.

(57) ABSTRACT

A tramp metal separation device for removing contaminants from a stream of raw materials that is being conveyed by a pneumatic conveying line. The tramp metal separation device includes a first housing, a drawer, and at least one actuator. The first housing has an inlet and an outlet that are connectable to the pneumatic conveying line. The drawer is supported with respect to the first housing such that the drawer is moveable between an extended position, where a plurality of magnets are positioned within the first housing and a retracted position, where the magnets are positioned outside of the first housing. A wiper assembly removes contaminants from the magnets as the drawer moves from the extended position to the retracted position. The actuator moves the drawer between its extended position and its retracted position.

20 Claims, 5 Drawing Sheets

SELF-CLEANING TRAMP METAL SEPARATION DEVICE FOR PNEUMATIC CONVEYING LINES

FIELD OF THE INVENTION

The invention pertains to devices for separating unwanted ferrous metals from particulate materials utilizing magnets, and, in particular, the invention pertains to separation devices having moveable magnets that are selectively positionable within a pneumatic conveying line for removal of metals from a stream of particulate material that is being conveyed by the pneumatic conveying line.

BACKGROUND

There are many devices which store or further process a supply of granular material in an industrial environment. Many devices, such as grain storage apparatus or pharmaceutical handling apparatus, are designed to simply direct a supply of granular material to containers for storage. Other devices, such as a variety of industrial fabricating devices, process the material to form a component therefrom. For example, a plastic injection molding machine typically accepts a supply of pelletized plastic material, melts the pellets, injects the resulting liquid plastic into a mold, and discharges a molded part after the part has formed and cooled.

The prior art with respect to devices which handle granular materials is best described by continuing the example with respect to a product-forming machine. In the past, it has been common to use an overhead hopper for feeding the granular pellets of raw material to the product-forming machines. A quantity of pellets is placed in a very large container, such as a self-contained feed hopper, positioned above and adjacent to the machine. This arrangement permits the pellets to be gravity fed continuously into the molding machine.

In this arrangement, all of the raw material in the overhead storage container is directed to the molding machine. Frequently, the supply of raw material includes unwanted microscopic foreign metal material or foreign metal bodies, in the form of metal fragments, screws, washers, or the like. Such unwanted metallic foreign contaminants are referred to as "tramp metals" in the industry. These contaminants may be found in the plastic materials as it comes from the manufacturer due to wear or flaws in the manufacturer's transportation, manufacturing, packaging or conveying machinery. Other metal contaminants may be introduced into the raw materials from operations associated with handling the material at the end manufacturing facility itself. In addition, the growing use of recycled plastic materials for molding purposes increases the frequency of contaminant occurrences in the raw material supplies. The process of reclaiming the recyclable plastics often results in unwanted metallic contaminants becoming intermixed with the recovered plastics as a result of poor separation techniques at material recycling facilities. Frequently, recycling houses process recyclable plastics by chopping them into pieces of suitable size for reuse in molding apparatus. These plastic pieces may contain minute metal contaminants, as well as imbedded metal brackets, screws, nuts, and so on.

The presence of these metallic contaminants in the raw materials being processed in product-forming machines is undesirable for a variety of reasons. Contaminants may actually damage an industrial machine or render the finished part unusable. Even if the part is properly formed, the customer may object to the presence of metal therein as it may cause unacceptable structural, visual, or magnetic aberrations in the finished part.

Magnetic separators have been installed at the feed side of such industrial processing equipment to ensure that metallic contaminants are removed. A magnetic separator typically comprises a housing component which acts as an intermediate hopper adapted to be placed above the forming machinery for the infeed of raw materials. One or more magnets are adapted to be removably inserted and secured in place in the feed path of this housing. As the granular material feeds through the housing, the metallic particles are attracted to the magnets. Periodically, the magnets are removed from the housing and the metallic materials are physically cleared from the magnets. The magnets are then reinserted into the housing for additional service.

It would be desirable to configure a tramp metal separation device such that the process of cleaning the magnets is automated.

SUMMARY

A tramp metal separation device taught herein is adapted to remove contaminants from a stream of raw materials that is being conveyed by a pneumatic conveying line. The pneumatic conveying line has an upstream portion and a downstream portion. The tramp metal separation device includes a first housing having an inlet and an outlet. The inlet is connectable to the upstream portion of the pneumatic conveying line and the outlet is connectable to the downstream portion of the pneumatic conveying line. The tramp metal separation device also includes a drawer that has a plurality of magnets and a wiper assembly. The drawer is supported with respect to the first housing such that it is moveable between an extended position, wherein the magnets are positioned within the first housing and are adapted to be in contact with the stream of raw materials, and a retracted position, wherein the magnets are positioned outside of the first housing. The wiper assembly removes contaminants from the magnets as the drawer moves from the extended position to the retracted position. At least one actuator is operatively connected to the drawer for moving the drawer between its extended position and its retracted position.

The first housing may be engageable with the drawer when the drawer is in the extended position to seal the drawer with respect to the first housing. The first housing may also be configured to be pneumatically sealed between the upstream and downstream portions of the pneumatic conveying line, such that the first housing does not introduce atmosphere air into the pneumatic conveying line when the drawer is in the extended position.

The actuator may be pneumatically operated. Alternatively, the actuator may be electrically operated. In addition, the tramp metal separation device may include a controller that is operatively connected to the at least one actuator for controlling movement of the drawer between the extended position and the retracted position. The controller may be configured to automatically move the drawer from the extended position to the retracted position, then back to the extended position automatically, in response to a predetermined criteria. The predetermined criteria may be the passage of a predetermined period of time.

The tramp metal separation device may include a second housing that is connected to the first housing such that the magnets of the drawer are positioned at least partially within the second housing in the retracted position. The second housing includes a receptacle that is configured to receive the contaminants from the magnets. Furthermore, the second housing may substantially surround the drawer when the drawer is disposed within the second housing.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
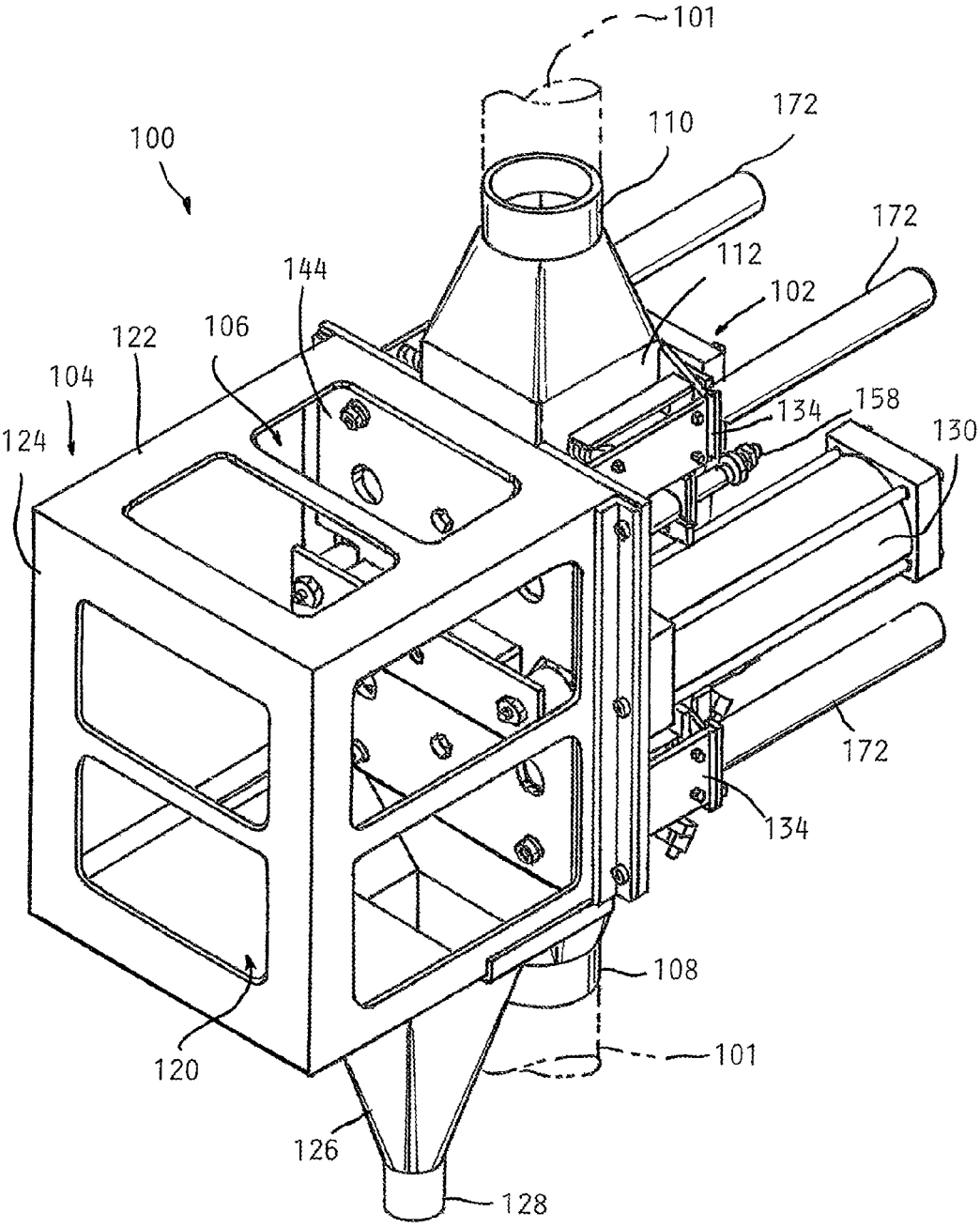
FIG. 1 is a perspective view showing a tramp metal separation device according to the invention.
Figure 2:
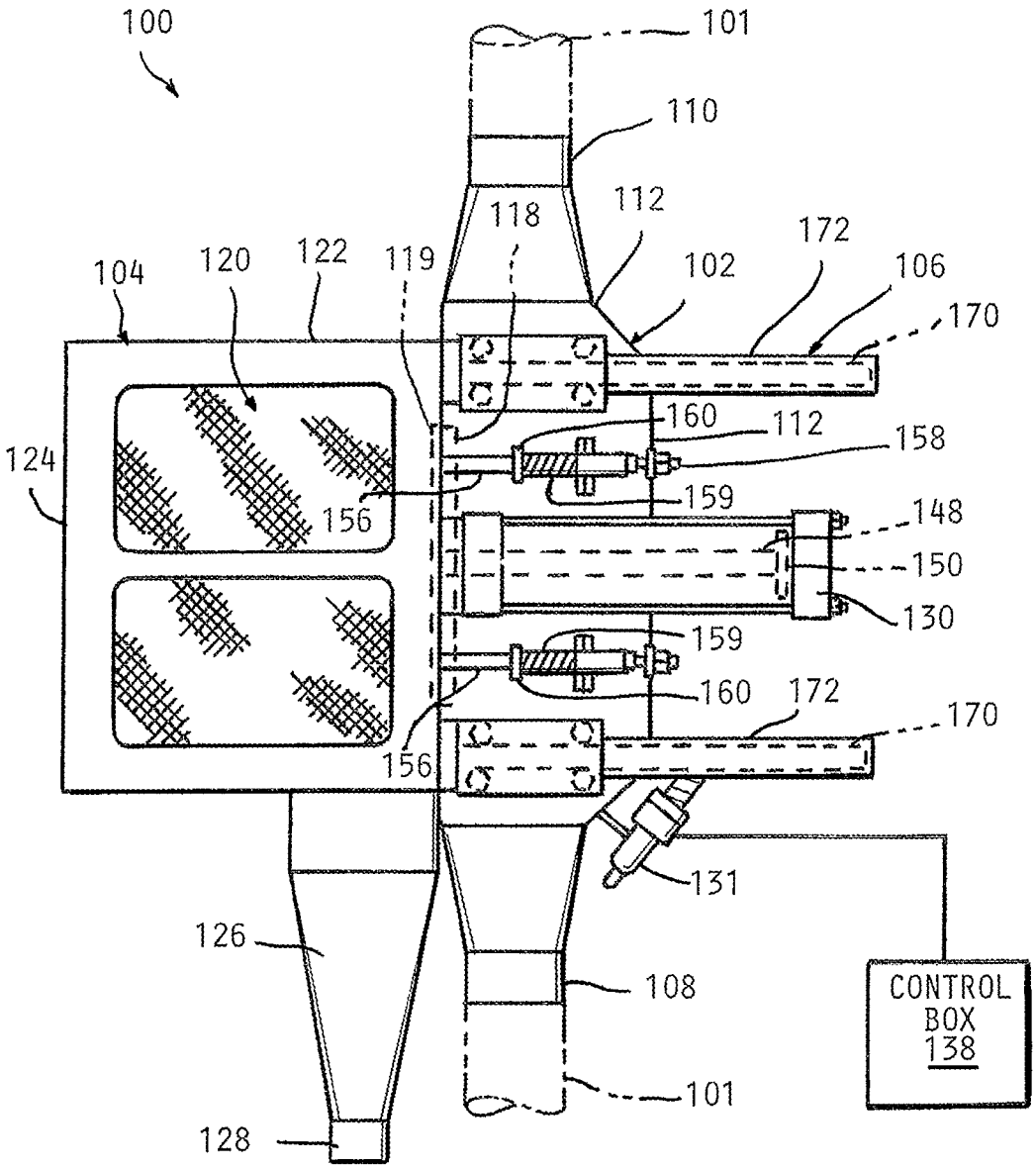
FIG. 2 is a side view showing the tramp metal separation device of FIG. 1.

FIGS. 1-2 show a self cleaning tramp metal separation device 100 for pneumatic conveying lines 101. The tramp metal separation device 100 includes a primary housing 102 and a secondary housing 104. The tramp metal separation device 100 also includes a magnet drawer 106. Portions of the magnet drawer 106 are selectively positionable within the primary housing 102 for removing metallic contaminants from a stream of raw materials (not shown) that is passing through the primary housing 102. Portions of the magnet drawer 106 are also selectively positionable within the secondary housing 104, where metallic contaminants are removed from the magnet drawer 106, as will be described further herein.

The primary housing 102 is typically fabricated as a thin-walled metallic structure, although it should be understood that other materials could be utilized. The primary housing 102 is connectable to pneumatic conveying lines 101 that move the raw materials under the influence of negative pressure that is supplied by a pneumatic conveying system (not shown). In particular, the primary housing 102 is adapted to receive a flow of raw material at an inlet 108. The inlet 108 may be a large, square or rectangular opening that is positioned at either of the top or the bottom of the primary housing 102. However, it should be understood that the inlet 108 is not committed to this position or geometry. The raw material is discharged from the primary housing at an outlet 110. The outlet 110 may be a large, square or rectangular opening that is positioned at the top of the primary housing 102. However, it should be understood that the outlet 110 could be provided having other shapes or positions. In particular, it should be understood that the positions of the inlet and outlet could be reversed. The primary housing 102 is configured to be pneumatically sealed between the inlet 108 and the outlet 110, such that the primary housing 102 does not introduce atmospheric air into the pneumatic conveying lines 101 during normal operation.

Between the inlet 108 and the outlet 110, the primary housing 102 is defined by a peripheral wall 112 that spaces the inlet 108 from the outlet 110. In order to allow access into the interior of the primary housing 102, a door (not shown) may be provided along the peripheral wall 112.

An opening 118 is provided in the peripheral wall 112 of the primary housing 102 adjacent to the secondary housing 104. The opening 118 is adapted to allow movement of at least a portion of the magnet drawer 106 between the primary housing 102 and the secondary housing 104.

The secondary housing 104 defines an interior 120 into which at least a portion of the magnet drawer 106 may be received for cleaning purposes. The secondary housing 104 is defined by a top surface 122, a peripheral wall 124, a substantially conical or pyramidal funnel portion 126 opposite the top surface 122 and adjacent to the primary housing 102, and an outlet tube 128 at a base of the funnel portion 126 and opposite the top surface 122. An opening 119 is formed through the peripheral wall 124 of the secondary housing 104 adjacent to the primary housing 102 to allow movement of at least a portion of the magnet drawer 106 into the secondary housing 104 for the purpose of cleaning the magnet drawer 106. As will be explained further herein, when the magnet drawer 106 is moved into the secondary housing 104, metallic contaminants are removed from the magnet drawer 106 and are directed out of the enclosed interior 120 of the secondary housing 104 through the outlet tube 128.

To support the magnet drawer 106 for movement between an extended position and a retracted position, a plurality of support rods 170 are slidably connected to the primary housing 102. The support rods 170 may be disposed in a substantially rectangular configuration to support the magnet drawer 106, as shown in the illustrated embodiment or another configuration suitable to support the magnet drawer 106. A bearing housing 134 having a plurality of bearings 136 disposed therein is associated with each of the support rods 170. In particular, each bearing housing 134 is rigidly connected to the primary housing 102 and is slidably related to a respective one of the support rods 170 to facilitate movement of the magnet drawer 106. In order to shield and enclose the support rods 170, an enclosure 172 is associated with each support rod 170 and is rigidly mounted to a respective one of the bearing housings 134, such that the support rods 170 slide within the enclosures 172.

To facilitate automatic movement of the magnet drawer 106, as will be explained in detail herein, a plurality of actuators are provided, such a pair of linear actuators 130. In the illustrated embodiment, the linear actuators 130 are pneumatic linear actuators that are controlled by a solenoid-operated pneumatic valve assembly 131, as is well known in the art. However, it should be understood that the linear actuators 130 could be any now known or later-developed linear actuators, such as electrical or hydraulic linear actuators. It should also be recognized that devices such as ball screws, lead screws, and gear racks could be provided to drive the linear actuators 130 using a rotational input.

The tramp metal separation device 100 may also include a control box 138 that controls motion of the linear actuators 130. For example, in systems including the pneumatic valve assembly 131 that is taught herein, the control box 138 provides appropriate electrical operating signals to the pneumatic valve assembly 131, which causes the pneumatic valve assembly to provide pressurized air to the linear actuators 130 as necessary to cause the desired motion. The control box 138 typically includes a programmable controller having a central processing unit, ROM, RAM, and various inputs and outputs as is well known in the art.

The magnet drawer 106 will now be explained with reference to FIGS. 3-4. The magnet drawer 106 includes a face plate 144 that is slidably mounted within the secondary housing 104 for movement along an extension axis 146 between the extended position and the retracted position. In a typical tramp metal separation device 100, as illustrated herein, the extension axis 146 may be substantially horizontal. However, other orientations may be provided as well.

The face plate 144 of the magnet drawer 106 is slidably supported by the support rods 170. The support rods 170 are securely connected to the face plate 144 in a rigid manner, such as using mechanical securement including bolts or other suitable fasteners. The support rods 170 and the bearing housings 134 associated therewith are the primary support structures for the upper drawer 140 and thus are sufficiently strong to support such a loading.

In order to connect the linear actuators 130 to the face plate 144 such that the linear actuators 130 may drive the magnet drawer 106 between the extended and retracted positions, the linear actuators 130 each include an extension rod 148. The extension rods 148 are at least partially disposed within the linear actuators 130, which move the extension rods 148 and the face plate 144 of the upper drawer 140 between the extended and retracted positions. A mechanical stop 150 may be provided on each of the extension rods 148 within the pair of linear actuators 130 in order to prevent overextension and accidental dislodgment of the extension rods 148 from the linear actuators 130.

In order to remove metallic contaminants from the stream of raw materials that is passing through the primary housing 102, a plurality of magnets 152 are connected to the face plate 144 of the magnet drawer 106. The magnets 152 are elongate, such that each magnet 152 extends across a majority of the width of the primary housing 102 when disposed therein. Typically, the magnets 152 are cylindrical in shape. The magnets 152 are strong magnets, and most typically are rare earth magnets, such that the magnetic force produced by the magnets 152 is sufficient to remove contaminants from the stream of raw materials. Optionally, the magnets 152 may be comprised of a stainless steel tube that covers and encloses a solid core of magnetic material.

The magnets 152 may be connected to the face plate 144 in a cantilever fashion using mechanical securement such as bolts or similar fasteners. The magnets 152 extend from the face plate 144 such that the majority of each magnet 152 may be disposed within the primary housing 102 during operation of the tramp metal separation device 100. In the illustrated embodiment, seven magnets 152 are provided in a staggered configuration to ensure contact of the raw materials with the magnets 152. However, it should be understood that the number of magnets may be varied according to the requirements of a particular application.

The magnet drawer 106 further includes a wiper plate 154 that is disposed within the secondary housing 104 between the face plate 144 and the peripheral wall 124 of the secondary housing 104. As will be described further herein, each of the magnets 152 extends through the wiper plate. Furthermore, as with the face plate 144, the wiper plate 154 also moves between extended and retracted positions along the extension axis 146. However, the range of motion of the wiper plate 154 is far shorter than that of the face plate 144 to allow the magnets 152 to move with respect to the wiper plate 154 such that at least a majority of the length of each of the magnets 152 slides through the wiper plate 154 to allow cleaning of the magnets 152 within the secondary housing 104, as will also be explained herein.

The wiper plate 154 is supported for sliding movement within the secondary housing 104 on extension rods 156. The extension rods 156 are rigidly secured to the wiper plate 154, and each extends into and is retained by a rod support 158. The rod supports 158 are positioned on both sides of the secondary housing 104 in a substantially rectangular configuration in the illustrated embodiment. Springs 159 are provided on the rod supports 158 to bias the extension rods 156 such that wiper plate 154 moves to the retracted position in concert with the face plate 144, upon movement of the face plate 144 to the retracted position under the influence of the linear actuators 130. Mechanical stops 160, such as shoulders or projections, are provided on the extension rods 156 to prevent overextension of the extension rods 156 out of the rod supports 158.

Figure 5:
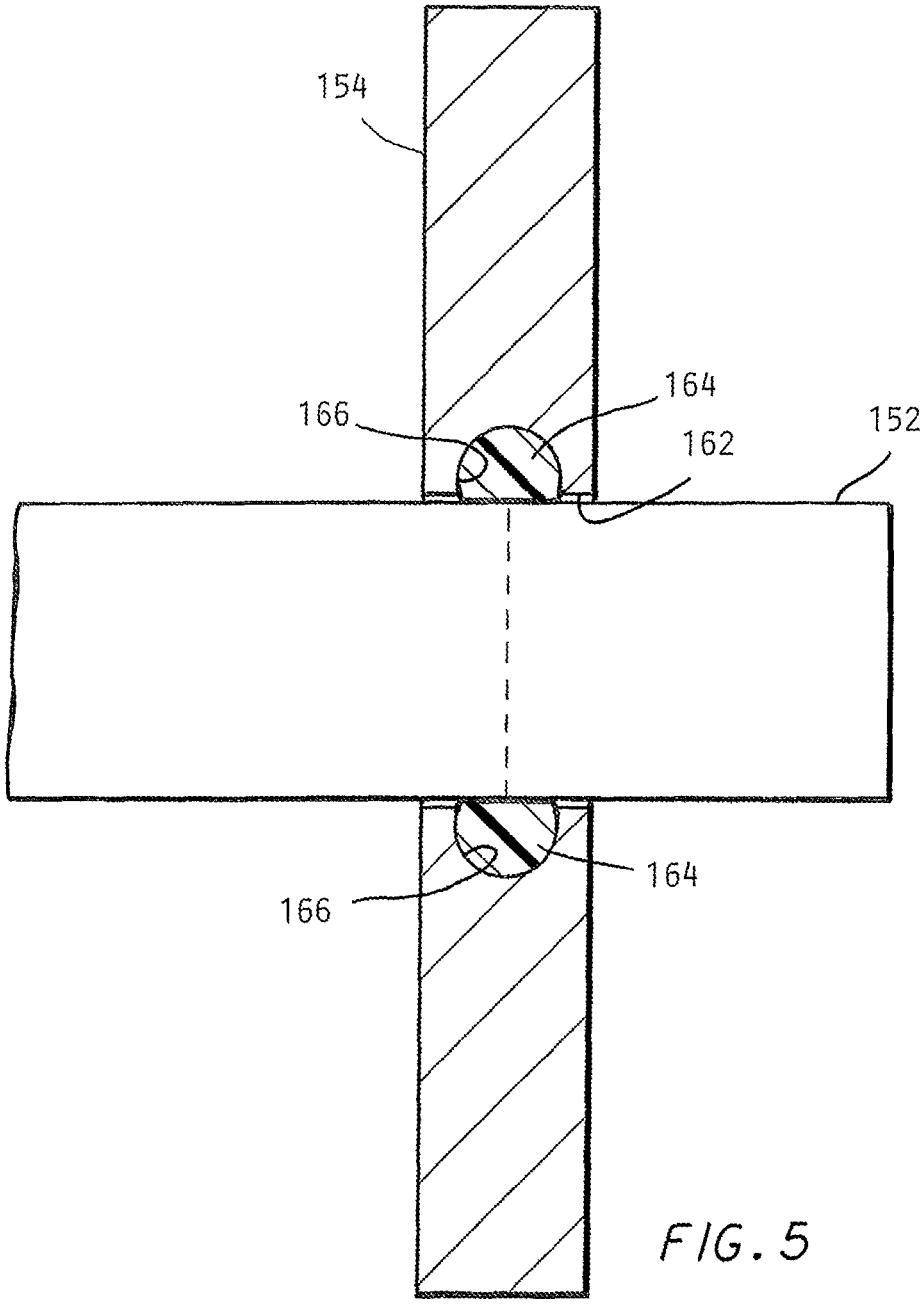
FIG. 5 is a detail showing a portion of the magnet drawer including a wiper plate and a magnet.

To allow cleaning of the magnets 152 by the wiper plate 154, each magnet extends through a respective bore 162 that is formed through the wiper plate 154, as shown in FIG. 5. The bores are complementary in shape to the magnets 152, and thus may be cylindrical in shape.

Within each bore 162, a wiper element 164, such as an o-ring, is seated within a groove 166 that is formed along the bore 162. Thus, as the magnets 152 move with respect to the wiper plate 154 through the bores 162 in the wiper plate 154, the ferromagnetic contaminants on the magnets 152 are wiped by the wiper elements 164 and fall away from the magnets 152 and into the enclosed interior 120 of the secondary housing 104.

Figure 3:
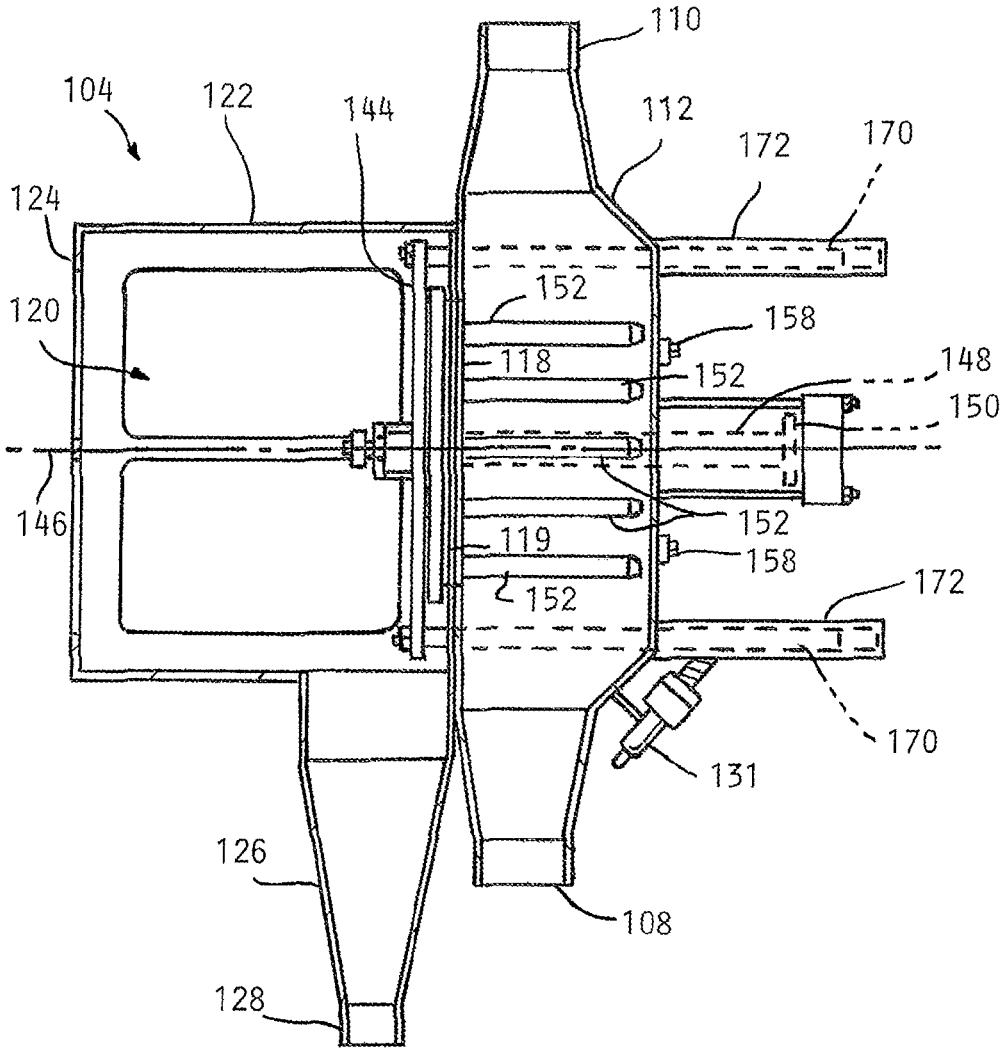
FIG. 3 is a side, cut-away view of the tramp metal separation device of FIG. 1 showing a magnet drawer of the tramp metal separation device in an extended position.
Figure 4:
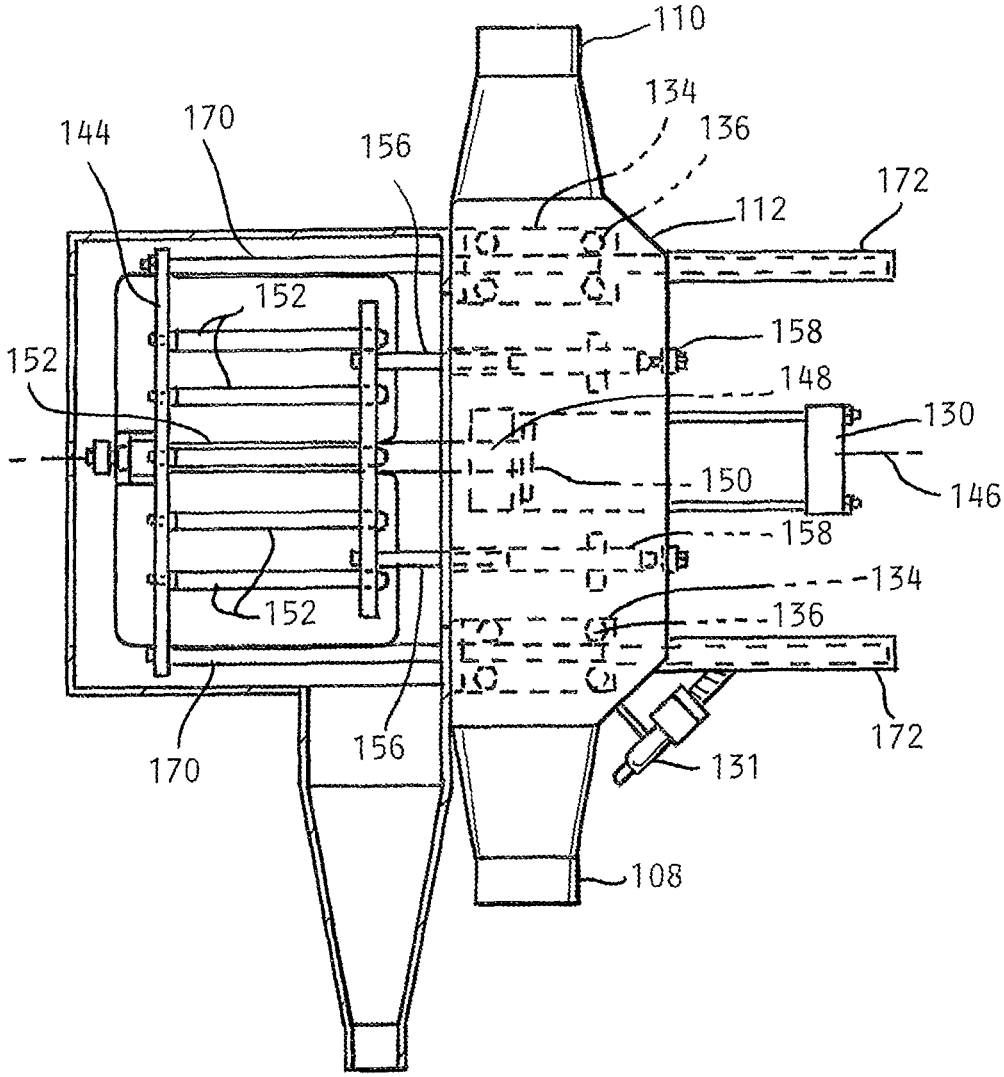
FIG. 4 is a side, cut-away view of the tramp metal separation device of FIG. 1 showing a magnet drawer of the tramp metal separation device in an retracted position.

With further reference to FIGS. 3-4, and in light of the foregoing description, it will be appreciated that the magnets 152 are cleaned as the magnet drawer 106 moves between the extended and retracted positions. In the extended position, the magnets 152 of the magnet drawer 106 are disposed within the primary housing 102 and thus are positioned within the stream of raw materials. In the retracted position, the magnets 152 of the magnet drawer 106 are positioned within the secondary housing 104 in order to remove ferromagnetic contaminants from the magnets 152.

The wiper plate 154 moves in correspondence with the face plate 144 as the magnet drawer 106 moves between its extended and retracted positions. In particular, the wiper plate 154 positioned adjacent to or in the openings 119 through the peripheral wall 124 of the secondary housing 104 when the magnet drawer 106 is in its extended position, thus capturing the wiper plate 154 between the face plate 144 of the magnet drawer 106 and the peripheral wall 124 of the secondary housing 104. In the retracted position, the wiper plate 154 of the magnet drawer 106 is spaced from the peripheral wall 124 of the secondary housing 104 at a relatively short distance therefrom, such that a majority of the length of each of the magnets 152 is disposed between the face plate 144 and the wiper plate 154 of the magnet drawer 106. Movement of the wiper plate 154 is facilitated by the springs 159, thereby moving the wiper plate 154 simultaneously with the face plate until the extension rods 156 that are attached to and supporting the wiper plate 144 are restrained from further movement by engagement of the mechanical stops 160.

In typical operation, cleaning of the magnets 152 is performed automatically, either at predetermined time intervals or in response to a user command that is provided to the control box 138. In systems where cleaning is performed automatically at predetermined times, the flow of raw materials to the inlet 108 of the primary housing 102 is first stopped by the pneumatic system that is providing the raw materials. Next, the control box 138 initiates a cleaning sequence of the tramp metal separation device 100. In this sequence, the control box 138 instructs the magnet drawer 106 to move from its extended position to its retracted position within the secondary housing 102. As the magnet drawer 106 is moved to its retracted position, the wiper elements 164 wipe the magnets 152 clean of accumulated ferromagnetic contaminants. As soon as this cleaning operation has been completed, the upper drawer 140 is then moved to its extended position. At this time, the pneumatic conveyor system then restores the flow of raw materials to the inlet 108 of the primary housing 102.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A tramp metal separation device for removing contaminants from a stream of raw materials that is being conveyed by a pneumatic conveying line having an upstream portion and a downstream portion, the tramp metal separation device comprising:

a first housing having an inlet, an outlet, and an opening, wherein the inlet is connectable to the upstream portion of the pneumatic conveying line and the outlet is connectable to the downstream portion of the pneumatic conveying line;

a drawer having a magnet assembly and a wiper assembly, the magnet assembly including a face plate and a plurality of elongate magnet members, the wiper assembly including a wiper plate having a plurality of bores that each have a respective one of the elongate magnet members extending therethrough, where the drawer is supported with respect to the first housing such that the drawer is moveable between an extended position, wherein the elongate magnet members are each positioned within the first housing and are adapted to be in contact with the stream of raw materials, the face plate is positioned adjacent to the opening, and the wiper plate is positioned adjacent to the face plate, and a retracted position, wherein the face plate is spaced from the opening, the wiper plate is spaced from the face plate, and the elongate magnet members are each positioned outside of the first housing and further wherein the wiper plate of the wiper assembly has a range of motion that is shorter than the range of motion of the magnet assembly, such that the face plate of the magnet assembly slides away from the wiper plate of the wiper assembly and the elongate magnet members slide through the bores of the wiper plate while the drawer moves from the extended position to the retracted position to remove contaminants from the elongate magnet members; and at least one actuator operatively connected to the magnet assembly of the drawer for moving the drawer between its extended position and its retracted position.

2. The tramp metal separation device of claim 1, wherein the first housing is in engagement with the face plate of the drawer when the drawer is in the extended position to seal the drawer with respect to the first housing and is further configured to be pneumatically sealed between the upstream and downstream portions of the pneumatic conveying line, such that the first housing does not introduce atmospheric air into the pneumatic conveying line when the drawer is in the extended position.

3. The tramp metal separation device of claim 1, wherein the at least one actuator is at least one of pneumatically operated or electrically operated.

4. The tramp metal separation device of claim 1, further comprising:

a controller operatively connected to the at least one actuator for controlling movement of the drawer between the extended position and the retracted position.

5. The tramp metal separation device of claim 4, wherein the controller automatically moves the drawer from the extended position to the retracted position, then back to the extended position automatically, in response to a predetermined criteria.

6. The tramp metal separation device of claim 5, wherein the predetermined criteria is the passage of a predetermined period of time.

7. The tramp metal separation device of claim 1, further comprising:

a second housing that is fixedly connected to the first housing and is located adjacent to the first housing such that the elongate magnet members of the drawer are not positioned within the second housing when the drawer is in the extended position, the elongate magnet members of the drawer are positioned at least partially within the second housing in the retracted position, and the second housing includes a receptacle configured to receive the contaminants from the elongate magnet members, wherein the second housing substantially surrounds the drawer when the drawer is disposed within the second housing.

8. A tramp metal separation device for removing contaminants from a stream of raw materials that is being conveyed by a pneumatic conveying line having an upstream portion and a downstream portion, the tramp metal separation device comprising:

a first housing having an inlet and an outlet, wherein the inlet is connectable to the upstream portion of the pneumatic conveying line and the outlet is connectable to the downstream portion of the pneumatic conveying line;

a face plate;

a plurality of elongate magnet members that each extend from a first end to a second end, wherein the first end of each elongate magnet member is connected to the face plate;

a wiper plate having a plurality of bores that each have a respective one of the elongate magnet members extending therethrough;

at least one actuator operatively connected to the face plate, for moving the face plate and the elongate magnet members in unison between an extended position and a retracted position; and a support structure operatively connected to the wiper plate for supporting the wiper plate for movement between an operating position and a cleaning position, the support structure having a biasing element for biasing the wiper plate toward the face plate and a mechanical stop for limiting travel of the wiper plate away from the first housing, wherein movement of the face plate from the extended position toward the retracted position causes movement of the wiper plate under influence of the biasing element, and the face plate continues moving toward the retracted position after movement of the wiper plate is limited by the mechanical stop at the cleaning position such that the elongate magnet members are cleaned as they slide through the bores of the wiper plate while the face plate continues moving toward the retracted position.

9. The tramp metal separation device of claim 8, further comprising:

a controller operatively connected to the at least one actuator for controlling movement of the face plate and the elongate magnet members between the extended position and the retracted position, wherein the controller automatically moves the face plate from the extended position to the retracted position, then back to the extended position automatically, in response to a predetermined criteria.

10. The tramp metal separation device of claim 9, wherein the predetermined criteria is the passage of a predetermined period of time.

11. The tramp metal separation device of claim 8, further comprising:

a second housing connected to the first housing such that the elongate magnet members are positioned at least partially within the second housing in the retracted position, the second housing including a receptacle configured to receive the contaminants from the elongate magnet members.

12. A tramp metal separation device for removing contaminants from a stream of raw materials that is being conveyed by a pneumatic conveying line having an upstream portion and a downstream portion, the tramp metal separation device comprising:

a first housing having an inlet and an outlet, wherein the inlet is connectable to the upstream portion of the pneumatic conveying line and the outlet is connectable to the downstream portion of the pneumatic conveying line;

a face plate;

a plurality of elongate magnet members that each extend from a first end to a second end, wherein the first end of each elongate magnet member is connected to the face plate;

a wiper plate having a plurality of bores that each have a respective one of the elongate magnet members extending therethrough;

at least one actuator operatively connected to the face plate, for moving the face plate and the elongate magnet members in unison between an extended position and a retracted position;

a support structure operatively connected to the wiper plate for supporting the wiper plate for movement with respect to the first housing between an operating position and a cleaning position, wherein the wiper plate is disposed within the first housing, is located adjacent to the face plate, and is located adjacent to the first ends of the elongate magnet members when the wiper plate is in the operating position and the face plate is in the extended position, and the wiper plate is disposed outside of the first housing, is spaced apart from the face plate, and is located adjacent to the second ends of the elongate magnet members when the wiper plate is in the cleaning position and the face plate is in the retracted position, wherein the support structure includes a biasing element that biases the wiper plate toward the cleaning position and a mechanical stop that stops movement of the wiper plate when the wiper plate reaches the cleaning position; and a controller operatively connected to the at least one actuator for causing the face plate to move from the extended position toward the retracted position such that the wiper plate moves in unison with the face plate until the wiper plate reaches the cleaning position and the face plate continues moving with respect to the wiper plate after the wiper plate reaches the cleaning position such that the elongate magnet members are cleaned as they slide through the bores of the wiper plate while the face plate moves toward the retracted position.

13. The tramp metal separation device of claim 12, further comprising:

a second housing connected to the first housing such that the elongate magnet members are positioned at least partially within the second housing in the retracted position, the second housing including a receptacle configured to receive the contaminants from the elongate magnet members.

14. The tramp metal separation device of claim 12, further comprising:

the at least one actuator including a pair of linear actuators.

15. The tramp metal separation device of claim 12, further comprising:

a plurality of support rods that are rigidly connected to the face plate and are slidably supported with respect to the first housing for supporting the face plate during movement thereof between the extended position and the retracted position.

16. The tramp metal separation device of claim 15, further comprising:

the plurality of support rods including four support rods disposed in a substantially rectangular configuration; and the at least one actuator including a pair of linear actuators that are connected to the first housing and are connected to the face plate, wherein the linear actuators are vertically spaced between an upper pair of the support rods and a lower pair of the support rods.

17. The tramp metal separation device of claim 12, wherein the at least one actuator is a pneumatically-operated linear actuator.

18. The tramp metal separation device of claim 1, wherein the elongate magnet members each extend from a first end to a second end, the first end of each elongate magnet member is connected to the face plate, the wiper plate is positioned adjacent to the first ends of the elongate magnet members when the drawer is in the extended position, and the wiper plate is positioned adjacent to the second ends of the elongate magnet members when the drawer is in the retracted position.

19. The tramp metal separator of claim 1, wherein the wiper assembly includes a support structure that limits the range of motion of the wiper plate and the at least one actuator is operable to cause the magnet assembly and the wiper assembly to move in unison from the extended position toward the retracted position until reaching an end of travel of the wiper plate, and to move the move the magnet assembly with respect to the wiper assembly for after reaching the end of travel of the wiper plate.

20. The tramp metal separator of claim 1, wherein the wiper assembly includes a support structure having a biasing element that biases the wiper plate toward the face plate of the magnet assembly and a mechanical stop that limits the range of motion of the wiper plate.

* * * * *